US005913630A

United States Patent [19]

Kelders et al.

[11] Patent Number: 5,913,630

[45] Date of Patent: Jun. 22, 1999

[54] DISPENSING CAP FOR A LIQUID CONTAINER

[76] Inventors: Johannes Hubertus Jozef Maria Kelders, Eendekooi 22, NL-5151 RL Drunen; Markus Franciskus Brouwer, Krabbehoek 13, NL-5348 MS Heesch, both of Netherlands

[21] Appl. No.: 09/068,601

[22] PCT Filed: Nov. 11, 1996

[86] PCT No.: PCT/NL96/00443

§ 371 Date: Jul. 9, 1998

§ 102(e) Date: Jul. 9, 1998

[87] PCT Pub. No.: WO97/17213

PCT Pub. Date: May 15, 1997

[30] Foreign Application Priority Data

Nov. 10, 1995 [NL] Netherlands ..... 1001626

[51] Int. Cl.[6] ..... B43L 19/00; A45D 34/00

[52] U.S. Cl. ..... 401/126; 401/26; 401/36; 401/122

[58] Field of Search ..... 401/126, 36, 26, 401/122

[56] References Cited

U.S. PATENT DOCUMENTS 2,869,162 1/1959 Dritz ..... 401/126 X
4,063,829 12/1977 La Mura .

FOREIGN PATENT DOCUMENTS 4101784 7/1992 Germany .
2226755 7/1990 United Kingdom .
9520497 8/1995 WIPO .

*Primary Examiner*—Steven A. Bratlie
*Attorney, Agent, or Firm*—Webb Ziesenheim Logsdon Orkin & Hanson, P.C.

[57] ABSTRACT

The invention relates to a dispensing cap for a liquid container provided with an applicator fixed thereto and for insertion into an opening of the liquid container. The dispensing cap has a closable outlet opening in its outer end located opposite the applicator. The opening is connected along a channel running through the dispensing cap to a feed aperture arranged in the vicinity of the applicator. A closing member co-acts with the feed aperture. The invention likewise relates to a liquid container provided with a dispensing cap of the above described type.

18 Claims, 3 Drawing Sheets

DISPENSING CAP FOR A LIQUID CONTAINER

BACKGROUND OF THE INVENTION

The invention relates to a dispensing cap for a liquid container provided with an applicator means fixed thereto and for insertion into an opening of the liquid container, wherein the dispensing cap has a closable outlet opening in its outer end located opposite the applicator means, which opening is connected along a channel running through the dispensing cap to at least one feed aperture arranged in the vicinity of the applicator means.

Such a dispensing cap is known from EP-A-0 398 936. The known cap is intended for a bottle with correction fluid and is provided with a brush for placing in the neck of the bottle with which the correction fluid can be applied and spread when larger areas have to be corrected, and a pin tip with which smaller quantities of correction fluid can be dispensed.

The known dispensing cap has the drawback that, after the use of the pin tip, correction fluid can remain behind in the channel which, when the brush is subsequently used, can then run out along the handle thereof whereby an unintentionally large amount of correction fluid is spread onto the error for correcting. There is therefore the danger of for instance a part of a text round an error also being smeared with correction fluid. In addition, an excess dose of correction fluid results in a comparatively long drying time, while in this manner the content of the bottle is also consumed too quickly.

SUMMARY OF THE INVENTION

The invention therefore has for its object to provide an improved dispensing cap of the above described type wherein these drawbacks do not occur. This is achieved according to the invention by a closing member co-acting with the feed aperture. Due to such a closing member unused liquid is retained in the channel between the feed aperture and the outlet opening and can therefore not leak out.

Preferred embodiments of the cap according to the invention are described in the dependent claims.

The invention also relates to a liquid container provided with a dispensing cap as described above.

BRIEF DESCRIPTION OF THE DRAWINGS

The invention is elucidated with reference to the annexed drawings in which.

DESCRIPTION OF THE PREFERRED EMBODIMENTS

Figure 1:
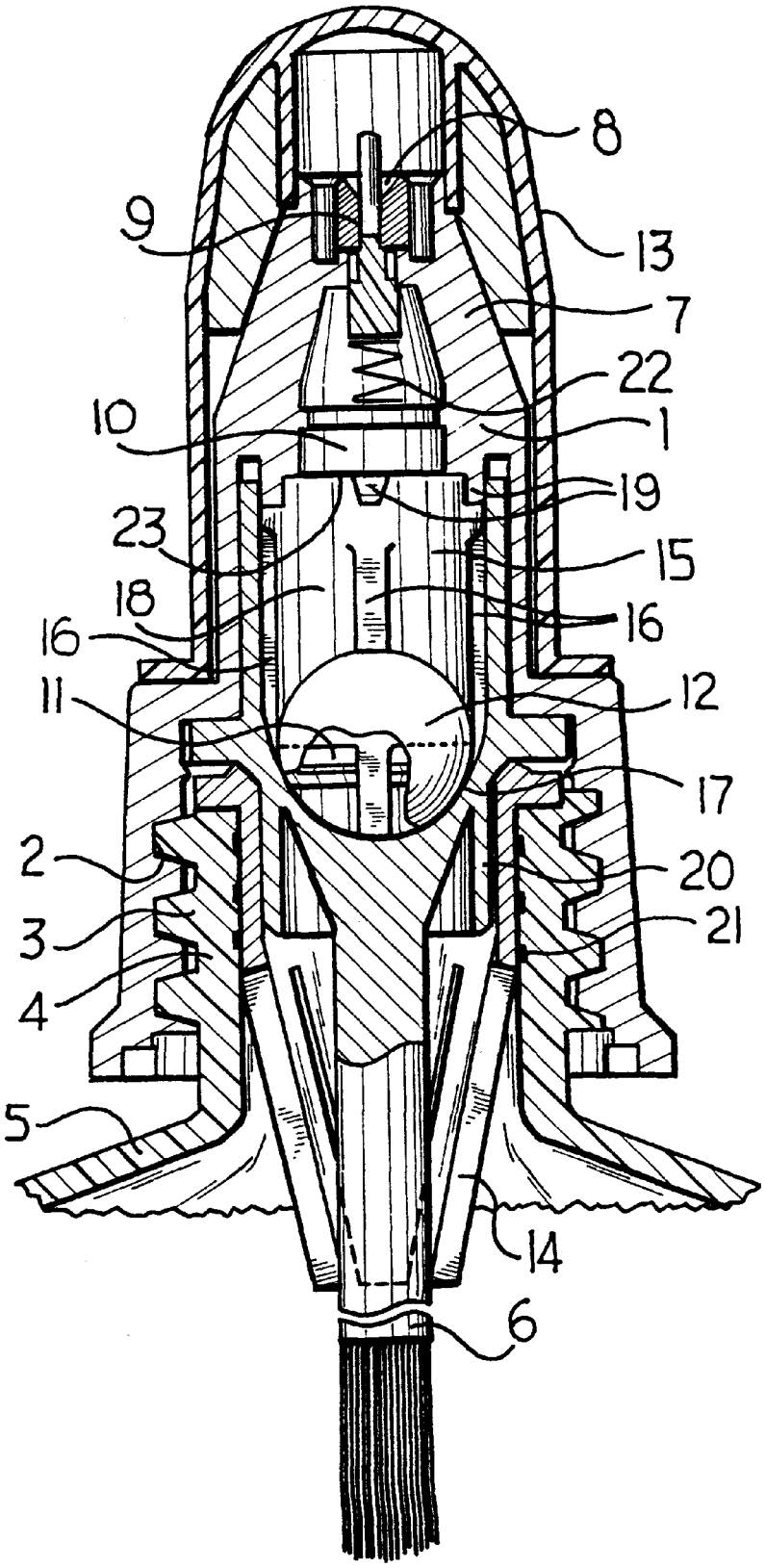
FIG. 1 shows a longitudinal section of a dispensing cap according to the invention arranged on a liquid container in its rest position.

A dispensing cap 1 (FIG. 1) is provided with an internal screw thread 2 with which it can be screwed onto a neck 4 of a container 5 likewise provided with screw thread 3. An applicator means 6, in the example shown a brush, is fixed in the dispensing cap 1. With brush 6 a liquid arranged in container 5, for instance correction fluid, can be applied in dosed manner to a surface such as a sheet of paper which has been written on. A comparatively large amount of liquid is herein dispensed.

Figure 2:
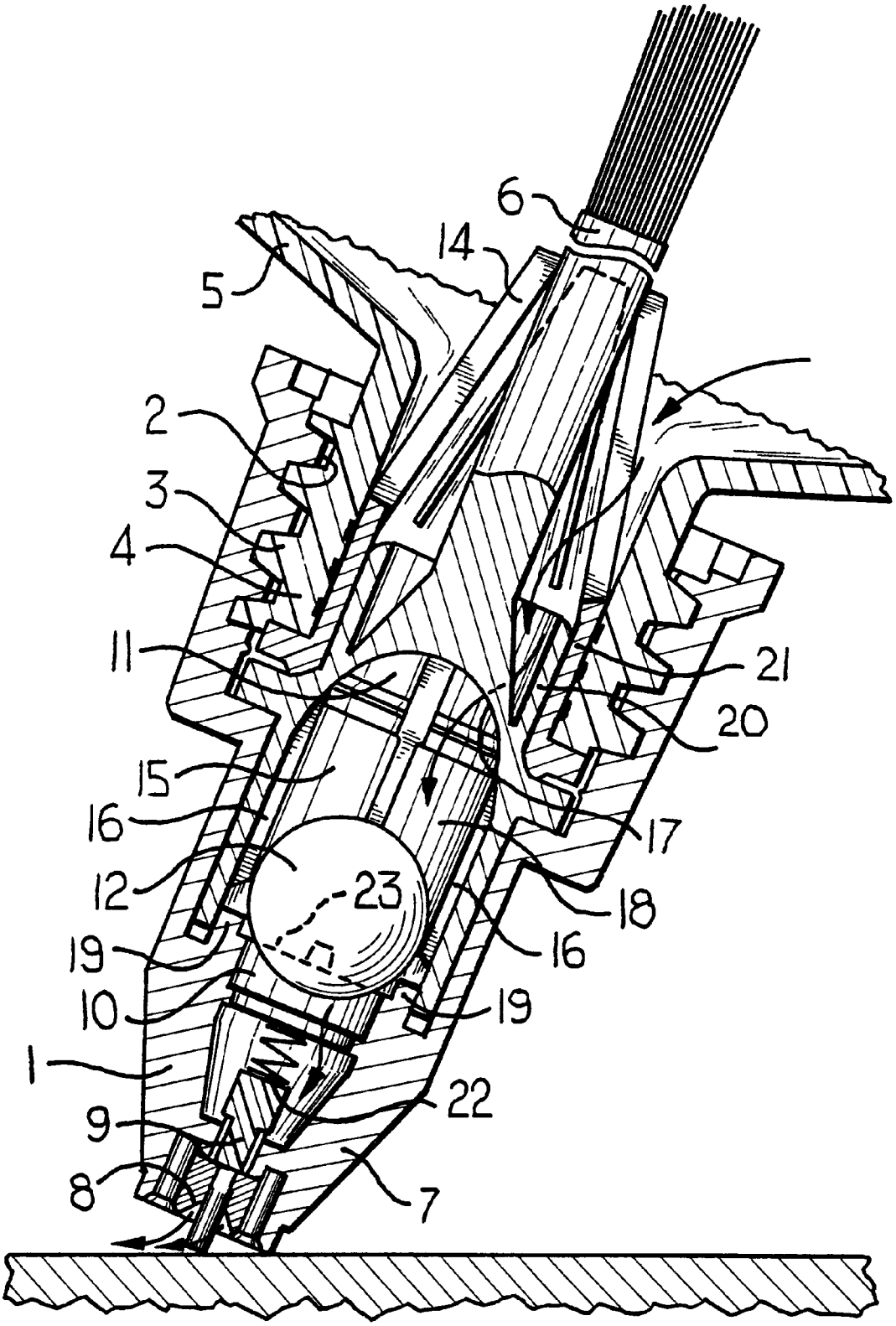
FIG. 2 shows a section corresponding with FIG. 1 of the liquid container with dispensing cap during use.
Figure 3:
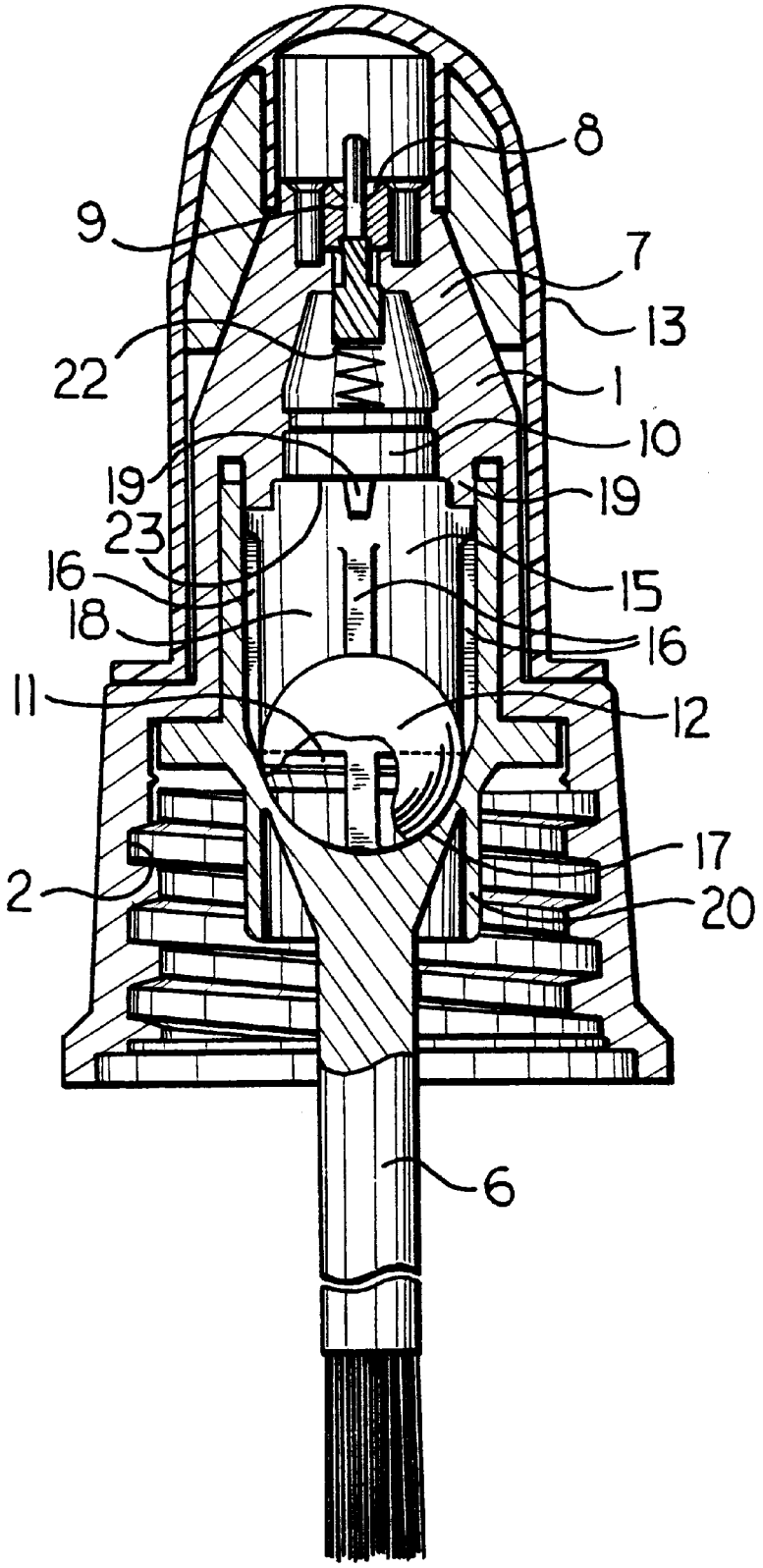
FIG. 3 is a section corresponding with FIG. 1 and 2 of the dispensing cap per se.

In order to also enable dispensing of more finely spread liquid the dispensing cap 1 is provided on its outer end 7 located opposite brush 6 with an outlet opening 8 which is closable by means of a needle valve 9. This needle valve 9 is movable in the outlet opening 8 and is biased by a pressure spring 22 connected to cap 1 to a rest position closing the opening 8. Valve 9 is pressed inward counter to the biasing force of spring 22 and thus leaves the opening 8 clear when it is pressed onto a surface (FIG. 2). The outlet opening 8 is connected via a channel 10 running through dispensing cap 1 to a plurality of radially directed feed apertures 11 which are arranged round the upper part of the brush 6 and which communicate with the interior of liquid container 5.

In order to prevent liquid which may have collected in channel 10 from leaking out through apertures 11 during the use of brush 6, the dispensing cap 1 according to the invention is provided with a closing member, in the example shown a ball 12. The ball 12 is movable in a widened portion 15 of channel 10 between a plurality of guide ribs 16 arranged distributed along the walls of the widened channel portion 15. Formed between these guide ribs 16 are bypass channels 18 whereby the liquid can pass along the closing ball 12 when dispensing cap 1 is pressed with its outlet opening 8 onto a surface. The end portion 17 of channel 10 directed toward brush 6 in which the feed apertures 11 debouch herein takes a spherical segment-shaped form such that the ball 12 can be received sealingly therein. On the top side the channel 10 is provided with a plurality of spacer member 19 whereby the ball 12 is held clear of the edge 23 of the narrowed upper portion of channel 10, thus ensuring an uninterrupted liquid flow from container 5 through the outlet opening 8 of cap 1.

In addition to the needle valve 9 a closing cap 13 is also arranged over outlet opening 8 so as to prevent drying and/or leakage. An annular sealing member or apron 20 is further arranged round brush 6. This sealing member 20 is received close-fittingly in a cylindrical part 21 of a wiping member 14 which is in turn received close-fittingly in the neck 4 of container 5. Leakage round the brush 6 is thus prevented when dispensing cap 1 is pressed with the outlet opening 8 onto a surface while possibly not being screwed completely into place on container 5.

We claim:

1. A dispensing cap for a liquid container, comprising:

an applicator means for insertion into an opening of the liquid container, wherein the dispensing cap has a closable outlet opening in its outer end located opposite the applicator means, which opening is connected along a channel running through the dispensing cap to at least one feed aperture arranged in the vicinity of the applicator means; and a closing member co-acting with the feed aperture.

2. The dispensing cap as claimed in claim 1, wherein the closing member is movable in the channel between a first position closing the feed aperture and a second position leaving clear the feed aperture.

3. The dispensing cap as claimed in claim 2, wherein the channel has a first portion in which the feed aperture is situated and the dimensions of which correspond substantially with those of the closing member, in addition to a widened portion, the dimensions of which are larger than those of the closing member.

4. The dispensing cap as claimed in claim 3, wherein the closing member is ball-shaped and the first portion of the channel is configured as a spherical segment.

5. The dispensing cap as claimed in claim 4, including guide members protruding from side walls of the widened portion of the channel.

6. The dispensing cap as claimed in claim 4, including spacer members protruding from an end wall of the channel.

7. The dispensing cap as claimed in claim 4, including an annular sealing member arranged round the applicator means and configured to be inserted close-fittingly into the opening of the liquid container.

8. The dispensing cap as claimed in claim 7, including an annular sealing member arranged round the applicator means and configured to be inserted into the opening of the liquid container.

9. The dispensing cap as claimed in claim 3, including guide members protruding from side walls of the widened portion of the channel.

10. The dispensing cap as claimed in claim 9, including spacer members protruding from an end wall of the channel.

11. The dispensing cap as claimed in claim 9, including an annular sealing member arranged round the applicator means and configured to be inserted close-fittingly into the opening of the liquid container.

12. The dispensing cap as claimed in claim 3, including spacer members protruding from an end wall of the channel.

13. The dispensing cap as claimed in claim 12, including an annular sealing member arranged round the applicator means and configured to be inserted close-fittingly into the opening of the liquid container.

14. The dispensing cap as claimed in claim 3, including an annular sealing member arranged round the applicator means and configured to be inserted close-fittingly into the opening of the liquid container.

15. The dispensing cap as claimed in claim 1, including an annular sealing member arranged round the applicator means and configured to be inserted into the opening of the liquid container.

16. The dispensing cap as claimed in claim 15, including a wiping member arranged between the opening and the sealing member.

17. The dispensing cap as claimed in claim 16, wherein the wiping member has a cylindrical wall part co-acting with the sealing member.

18. A liquid container provided with a dispensing cap as claimed in claim 11.

* * * * *

UNITED STATES PATENT AND TRADEMARK OFFICE

CERTIFICATE OF CORRECTION

PATENT NO. : 5,913,630

DATED : June 22, 1999

INVENTOR(S) : Johannes H.J.M. Kelders et al.

It is certified that error appears in the above-identified patent and that said Letters Patent is hereby corrected as shown below:

Claim 18 Column 4, Last Line, "in claim 11" should read --in claim 1--.

Signed and Sealed this

Twenty-third Day of November, 1999

*Attest:*

Q. TODD DICKINSON

*Attesting Officer*

*Acting Commissioner of Patents and Trademarks*